US005317939A

United States Patent [19]

Marinescu

[11] Patent Number: 5,317,939

[45] Date of Patent: Jun. 7, 1994

[54] LIGHT BULB CHANGING DEVICE

[76] Inventor: Ilie Marinescu, 25-29 32nd St. #2B, Astoria, N.Y. 11102

[21] Appl. No.: 65,482

[22] Filed: May 24, 1993

[51] Int. Cl.[5] ..... H01K 3/32

[52] U.S. Cl. ..... 81/53.11; 294/100

[58] Field of Search ..... 81/53.1, 53.11, 53.12, 81/3.41; 294/19.1, 19.2, 19.3, 100

[56] References Cited

U.S. PATENT DOCUMENTS

| | | | |
|---|---|---|---|
| 2,357,104 | 8/1944 | Grinnell | 81/53.11 |
| 2,556,701 | 6/1951 | Mozena | 81/53.11 |
| 2,594,908 | 4/1952 | Gaulke et al. | 294/100 X |
| 4,575,143 | 3/1986 | Nast | 294/100 X |
| 4,987,634 | 1/1991 | Weihrauch | 294/100 X |

*Primary Examiner*—D. S. Meislin

*Attorney, Agent, or Firm*—Richard L. Miller

[57] ABSTRACT

A light bulb changing tool is provided which consists of an elongated pipe to be held by one hand of a person. An annular head is connected to an upper end of the pipe. A finger clamp assembly is carried within the annular head. A handle is slidable within a lower end of the pipe and is depressible by another hand of the person. A structure is coupled to the handle within the pipe for operating the finger clamp assembly. The finger clamp assembly can grip a light bulb to install and remove the light bulb from a lighting fixture at an elevated position from a floor. A guide assembly having a suction cup for also gripping the light bulb is carried within the finger clamp assembly to center and stabilize the light bulb within the clamp assembly.

4 Claims, 1 Drawing Sheet

LIGHT BULB CHANGING DEVICE

BACKGROUND OF THE INVENTION

The instant invention relates generally to light bulb removing devices and more specifically it relates to a light bulb changing tool.

Numerous light bulb removers have been provided in prior art that are adapted to install and remove electrical lamps from lighting fixtures by people standing on floors beneath the lighting fixtures. For example, U.S. Pat. No. 4,218,085 to Unger; U.S. Pat. No. 4,791,835 to Unger et al. and U.S. Pat. Des. 297,499 to Whitney all are illustrative of such prior art. While these units may be suitable for the particular purpose to which they address, they would not be as suitable for the purposes of the present invention as heretofore described.

SUMMARY OF THE INVENTION

A primary object of the present invention is to provide a light bulb changing tool that will overcome the shortcomings of the prior art devices.

Another object is to provide a light bulb changing tool that will grip a light bulb at an upper end, so that the light bulb can be installed or removed from a ceiling outlet located at an elevated position above a floor.

An additional object is to provide a light bulb changing tool that is adaptable to grip and stabilize various sized and shaped light bulbs, so that each light bulb can be properly installed or removed from the ceiling outlet.

A further object is to provide a light bulb changing tool that is simple and easy to use.

A still further object is to provide a light bulb changing tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENTS

Figure 1:
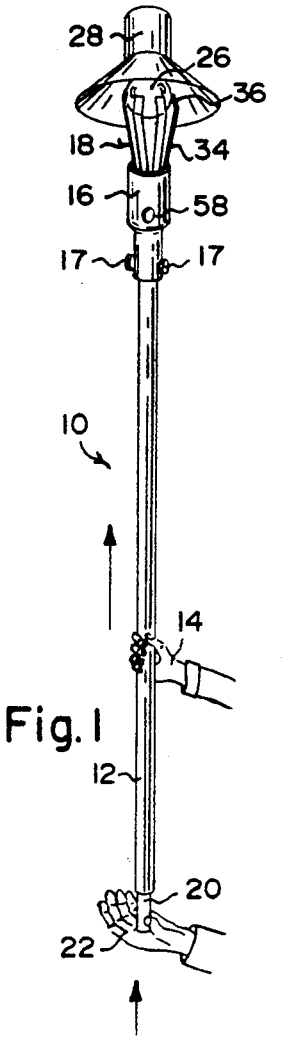
FIG. 1 is a diagrammatic perspective view of the instant invention being used to install or remove a light bulb.
Figure 4:
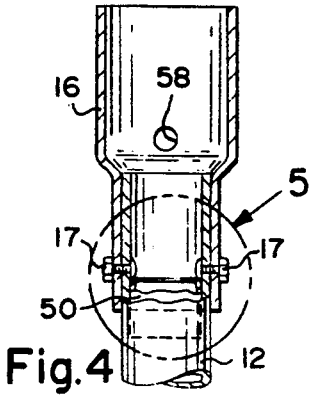
FIG. 4 is a still further enlarged diagrammatic elevational view of the upper portion of the housing, with parts broken away and in section.
Figure 2:
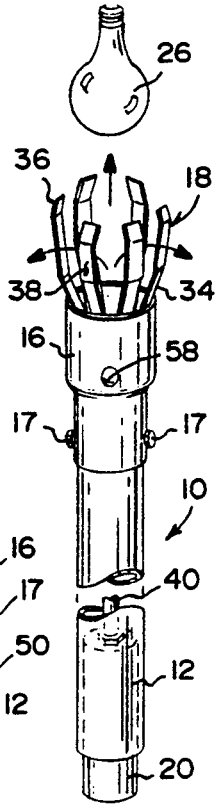
FIG. 2 is a diagrammatic partially exploded perspective view with parts broken away, showing the insulated fingers ready to receive a light bulb.
Figure 3:
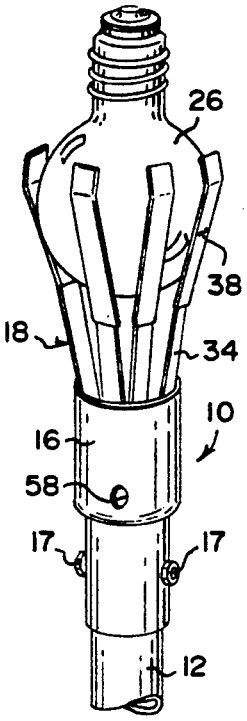
FIG. 3 is a still further enlarged diagrammatic perspective view of the instant invention grasping a light bulb.
Figure 5:
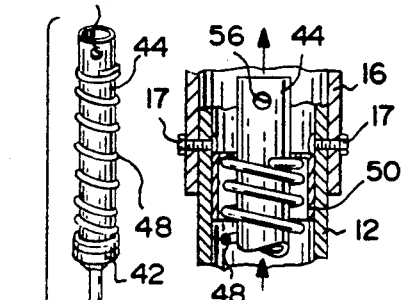
FIG. 5 is an enlarged sectional view thereof as indicated by arrow 5 in FIG. 4, with some of the internal components installed therein.
Figure 6:
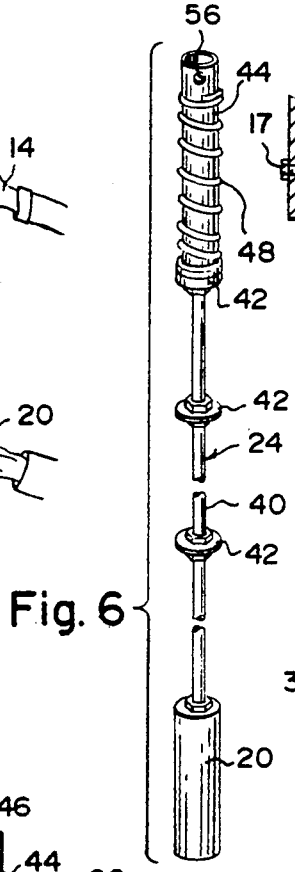
FIG. 6 is a diagrammatic perspective view with parts broken away of the internal components of the instant invention.
Figure 7:
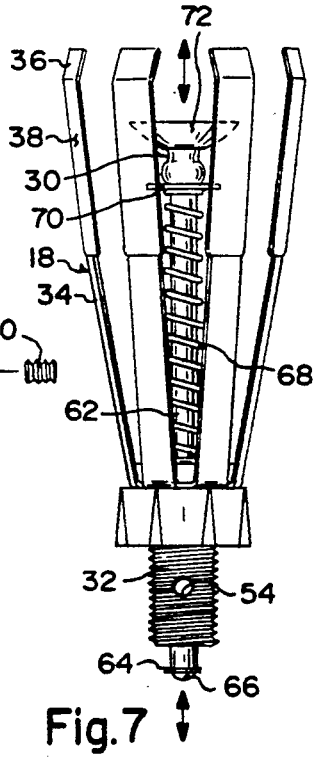
FIG. 7 is an enlarged elevational view of the bulb holding assembly thereof.
Figure 8:
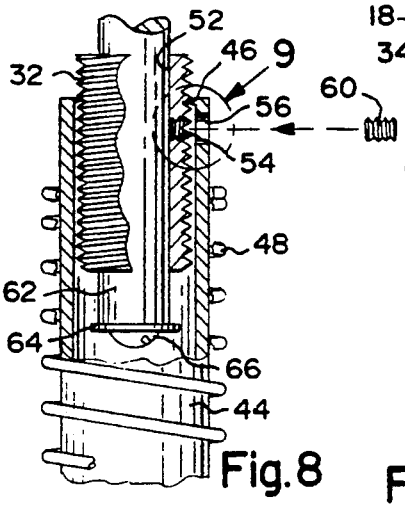
FIG. 8 is an enlarged diagrammatic elevational view with parts broken away and in section illustrating further construction details.
Figure 9:
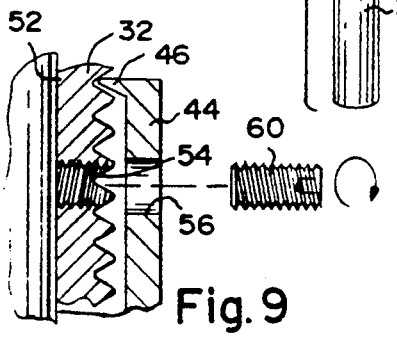
FIG. 9 is a still further enlarged diagrammatic cross sectional view as indicated by arrow 9 in FIG. 8.

Turning now descriptively to the drawings, in which similar reference characters denote similar elements throughout the several views, FIGS. 1 through 9 illustrate a light bulb changing tool 10 which consists of an elongated pipe 12 to be held by one hand 14 of a person. An annular head 16 is connected at fasteners 17 to an upper end of the pipe 12. A finger clamp assembly 18 is carried within the annular head 16. A handle 20 is slidable within a lower end of the pipe 12 and is depressible by another hand 22 of the person. A structure 24 is coupled to the handle 20 within the pipe 12, for operating the finger clamp assembly 18. The finger clamp assembly 18 can grip a light bulb 26, to install and remove the light bulb 26 from a lighting fixture 28 at an elevated position from a floor. A guide assembly 30 is carried within the finger clamp assembly 18, to center and stabilize the light bulb 26 within the clamp assembly 18.

The finger clamp assembly 18 includes an externally threaded collar 32. A plurality of flexible fingers 34 are provided, with each having a bent tip end 36 and are radially connected onto the collar 32. A protective coating 38 is applied to each finger 34, to prevent sliding of the light bulb 26 when gripped by the fingers 34.

The operating structure 24 contains an elongated rod 40 connected at a bottom end to the handle 20 within the pipe 12. A plurality of washers 42 are spaced apart and connected to the rod 40, so as to center the rod 40 within the pipe 12. A sleeve 44 is connected to a top end of the rod 40. The sleeve 44 has an internally threaded lip 46, to engage with the externally threaded collar 32 of the finger clamp assembly 18. A compression spring 48 is mounted over the sleeve 44. A retainer 50 is connected within the pipe 12, to bias the spring 48 on the sleeve 44. The spring 48 biases the handle 20 to return back to its original position, after the depressed handle 20 is released by the hand 22 of the person.

The externally threaded collar 32 has a longitudinal bore 52 therethrough and a transverse threaded hole 54. The sleeve 44 has a transverse aperture 56. The annular head 16 has a transverse opening 58. A setscrew 60 fits through the transverse opening 58 in the annular head 16, the transverse aperture 56 in the sleeve 44 and into the transverse threaded hole 54 in the externally threaded collar 32, to retain a shank 62 of the finger clamp assembly 18 within the sleeve 44.

The guide assembly 30 includes the shank 62 which fits through the longitudinal bore 52 in the externally threaded collar 32. A first washer 64 is affixed by a bolt 66 to a bottom end of the shank 62, to act as a stop. A compression spring 68 is on the shank 62. A second washer 70 is affixed to a top end of the shank 62, to bias the spring 68 on the shank 62, so that the spring 68 will normally raise the shank 62 upwardly toward the bent tip ends 36 of flexible fingers 34. A suction cup 72 is mounted on the top end of the shank 62, so as to engage with a bottom portion of the light bulb 26.

OPERATION OF THE INVENTION

To use the light bulb changing tool 10 a person simply depresses the handle 20 into the elongated pipe 12. This will cause the flexible fingers 34 to spread apart, so that the light bulb 26 can be engaged by the fingers 34 and suction cup 72, when the handle 20 is released. The elongated pipe 12 can then be lifted upwardly to install the light bulb 26 into the lighting fixture 28, after which the light bulb changing tool 10 is pulled away from the bulb with the finger spread open. To remove the light bulb 26 from the lighting fixture 28, depress the handle 20 again into the elongated pipe 12. The flexible fingers 34 and the suction cup can then both engage the light bulb 26 in the lighting fixture 28, so it can be removed therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A light bulb changing tool which comprises:

a) an elongated pipe to be held by one hand of a person;

b) an annular head connected to an upper end of said pipe;

c) a finger clamp assembly carried within said annular head;

d) a handle slidable within a lower end of said pipe and depressible by another hand of the person;

e) means coupled to said handle within said pipe for operating said finger clamp assembly, so that said finger clamp assembly can grip a light bulb to install and remove the light bulb from a lighting fixture at an elevated position from a floor; and f) a guide assembly carried within said finger clamp assembly to center and stabilize the light bulb within said clamp assembly, wherein said finger clamp assembly includes:

i) an externally threaded collar;

ii) a plurality of flexible fingers, each having a bent tip end and radially connected onto said collar; and iii) a protective coating applied to each said finger to prevent sliding of the light bulb when gripped by said fingers.

2. A light bulb changing tool as recited in claim 1, wherein said operating means includes:

a) an elongated rod connected at a bottom end to said handle within said pipe;

b) a plurality of washers, spaced apart and connected to said rod, so as to center said rod within said pipe;

c) a sleeve connected to a top end of said rod, said sleeve having an internally threaded lip to engage with said externally threaded collar of said finger clamp assembly;

d) a compression spring mounted over said sleeve; and e) a retainer connected within said pipe to bias said spring on said sleeve, so that said spring will try to return said handle back to an original position after said depressed handle is released by the hand of the person.

3. A light bulb changing tool as recited in claim 2, further including:

a) said externally threaded collar having a longitudinal bore therethrough and a transverse threaded hole;

b) said sleeve having a transverse aperture;

c) said annular head having a transverse opening; and d) a setscrew to fit through said transverse opening in said annular head, said transverse aperture in said sleeve and into said transverse threaded hole in said externally threaded collar to retain said finger clamp assembly within said sleeve.

4. A light bulb changing tool as recited in claim 3, wherein said guide assembly includes:

a) a shank to fit through said longitudinal bore in said externally threaded collar;

b) a first washer affixed to a bottom end of said shank to act as a stop;

c) a compression spring on said shank;

d) a second washer affixed to a top end of said shank to bias said spring on said shank, so that said spring will normally raise said shank upwardly; and e) a suction cup mounted on the top end of said shank, so as to engage with a portion of the light bulb.

* * * * *